US005396256A

United States Patent [19]

Chiba et al.

[11] Patent Number: 5,396,256

[45] Date of Patent: Mar. 7, 1995

[54] APPARATUS FOR CONTROLLING ARRAY ANTENNA COMPRISING A PLURALITY OF ANTENNA ELEMENTS AND METHOD THEREFOR

[75] Inventors: Isamu Chiba; Masayuki Fujise, both of Nara, Japan

[73] Assignee: ATR Optical & Radio Communications Research Laboratories, Kyoto, Japan

[21] Appl. No.: 141,642

[22] Filed: Oct. 27, 1993

[30] Foreign Application Priority Data

Oct. 28, 1992 [JP] Japan ..... 4-289954

[51] Int. Cl.[6] ..... H01Q 3/36

[52] U.S. Cl. ..... 342/372; 342/81; 342/157

[58] Field of Search ..... 342/372, 81, 157

[56] References Cited

U.S. PATENT DOCUMENTS

| | | | |
|---|---|---|---|
| 4,996,532 | 2/1991 | Kirimoto et al. | 342/81 |
| 5,087,917 | 2/1992 | Fujisaka et al. . | |
| 5,181,040 | 1/1993 | Inoue et al. | 342/149 |
| 5,283,587 | 2/1994 | Hirshfield et al. | 342/372 |

FOREIGN PATENT DOCUMENTS

| | | |
|---|---|---|
| 63-167287 | 7/1988 | Japan . |
| 63-167288 | 7/1988 | Japan . |

OTHER PUBLICATIONS

"Characteristics of CMA Adaptive Array for Selective Fading Compensation in Digital Land Mobile Radio Communications", Takeo Ohgane, Oct. 1990; pp. 489–497.

"Null Beam Forming by Phase Control of Selected Elements in Phased Array Antennas", Isamu Chiba et al., Jan. 1991, pp. 35–42.

Kenneth Teitelbaum, "A Flexible Processor for a Digital Adaptive Array Radar"; pp. 103–107, from Proceedings of the 1991 IEEE National Radar Conference; Mar. 12–13, 1991.

*Primary Examiner*—Thomas H. Tarcza
*Assistant Examiner*—Dao Phan

[57] ABSTRACT

In an apparatus and method for controlling an array antenna including a predetermined plurality of M antenna elements arranged in a predetermined arrangement configuration, beam electric field strengths of a plurality of N beams of transmitting signals are calculated, and then signals representing the calculated beam electric field strengths equal to or larger than a threshold value are outputted. Thereafter, based on the outputted signals, there are calculated a plurality of N weight coefficients for the receiving signals respectively corresponding to the plurality of N beams of transmitting signals, such that a main beam of the array antenna is directed toward an incoming direction of a desired radio wave and also a level of the receiving signal in an incoming direction of an unnecessary radio wave are made zero. Further, based on the calculated plurality of N weight coefficients and a transmitting frequency of the transmitting signals, there is calculated at least either one of a plurality of M amounts of phase shift and a plurality of M amounts of amplitudes for the transmitting signals, and then the antenna elements are controlled in accordance with at least one of the calculated amplitude and phase data, thereby radiating the controlled transmitting signals therefrom.

6 Claims, 11 Drawing Sheets

In-Phase Combining
Received Base Band Signal
Adaptive Control Processor
In-Phase Distributor
Beam Selecting
Multi-Beam Forming
Transmitting Base Band Signal
In—Phase Distributor
Phase Caluculating Processor
Receiver
A/D Converter
Phase Shifter
RM-1
RM-2
RM-M
100-1
100-2
100-M 1
100-1
100-2
100-M
RM-1
RM-2
RM-M
2
3
Receiver
4
A/D Converter
5
Phase Shifter
6
R1
F1
DP1
R2
F2
DP2
RM
FM
DPM
400
Distributor
500-1
Beam Forming
500-2
Beam Forming
500-N
Beam Forming
B1
B2
BN
101
Transmitting Pulse Distributor
Transmitting Pulse
F1
F2
FM
102
Transmitting Beam Controller
Target Azimuth and Distance Information
DP1
DP2
DPM

APPARATUS FOR CONTROLLING ARRAY ANTENNA COMPRISING A PLURALITY OF ANTENNA ELEMENTS AND METHOD THEREFOR

BACKGROUND OF THE INVENTION

1. Field of the Invention

The present invention relates to an apparatus for controlling an array antenna and a method therefor, and in particularly, to an apparatus for controlling an array antenna comprising a plurality of antenna elements arranged in a predetermined arrangement configuration and a method therefor.

2. Description of the Related Art

FIG. 6 shows a conventional phased array radar apparatus disclosed in Japanese Patent Laid-Open Publication No. 63-167287.

Referring to FIG. 6, an array antenna 1 comprises a plurality of natural number M of antenna elements 100-1 to 100-M, which are, for example, aligned, wherein each of transmission and reception modules RM-1 to RM-M respectively connected to the antenna elements 100-1 to 100-M comprises a circulator 2 used as an antenna combiner for commonly using one antenna element for reception and transmission, a receiver 3 having a frequency converter and a demodulator, an analog-to-digital converter (hereinafter, referred to as an A/D converter) 4, a phase shifter 5 for shifting a phase of a transmitting signal by a set amount of phase shift, and a high-frequency high output transmitting power amplifier (hereinafter, referred to as a high output power amplifier) 6 for amplifying and transmitting a high-frequency transmission signal.

A transmitting pulse divider and distributor circuit 101 divides a transmitting pulse, which is sent from an oscillator circuit (not shown) in a form modulated using a predetermined pulse modulation method, into a plurality of M subpulses, and then outputs the plurality of M subpulses to respective phase shifters 5 of the transmission and reception modules RM-1 to RM-M, respectively. On the other hand, information of target azimuth and distance is inputted to a transmitting beam control circuit 102. The control circuit 102, based on the inputted information, calculates respective amounts of phase shift for respective phase shifters 5 of the transmission and reception modules RM-1 to RM-M, and then outputs the same to respective phase shifters 5 of the transmission and reception modules RM-1 to RM-M, respectively. In this state, if a transmitting pulse is radiated toward a target object, the radiated transmitting pulse impinges on the target object and then is thereby reflected. After the resulting reflected signal is received by the array antenna 1, the reflected receiving signals received by the antenna elements 100-m are respectively inputted into the receivers 3 through the circulators 2, are respectively demodulated so as to obtain intermediate frequency signals by the receivers 3, and further the demodulated signals are respectively converted into a receiving digital signals R1 to RM by the A/D converters 4.

A distributor circuit 400 divides and distributes the receiving digital signals R1 to RM respectively outputted from respective transmission and reception modules RM-1 to RM-M into a plurality of N sets of digital signals, each set of digital signals including a plurality of N digital signals, and then outputs respective distributed N sets of digital signals to first to N-th beam forming circuits 500-1 to 500-N, respectively. Each of these beam forming circuits 500-1 to 500-N, using the receiving digital signals $R_1$ to $R_M$, controls their amplitude and phase with a predetermined manner, thereby forming beams of receiving signals in their respective desired directions and then outputting the same as a plurality of N beams of receiving signals $B_1$ to $B_N$. In this case, the beam forming circuits 500-1 to 500-N perform a process for eliminating effects of unnecessary radio waves which come up in directions other than the direction of the target object, and then extracts only reflected radio waves sent from the target object, further detects the direction, the distance, and the like of the target object.

In a method for eliminating unnecessary radio waves used in the above-mentioned conventional apparatus, as shown in FIG. 7, an auxiliary beam of radio signal formed by a pair of antenna elements is superimposed on a main beam of radio signal formed by all the antenna elements so that the phase of the auxiliary beam of radio signal is reverse to the main beam of radio signals, whereby the main beam of radio signal is directed toward the incoming direction of the desired radio wave and also the zero point of the radiation pattern is formed in an incoming direction of an unnecessary radio wave.

The phases of the transmitting signals are controlled by the phase shifters 5, while the receiving signals are subjected to beam formation by converting the analog signals received by respective antenna elements 100-m into the digital signals. This process is performed because of the following reasons. That is, since the transmitting radio signals must be radiated to a distant target object, it is necessary to amplify the transmitting signals with the high output power amplifier 6.

FIG. 8 shows input and output characteristics of the conventional high output power amplifier 6. As is apparent from FIG. 8, to make more efficient use of the high output power amplifier 6, the amplifier's saturation region in which its amplification factor becomes constant should be used. In other words, since the amplification factor of the high output power amplifier 6 is used at a constant value, it becomes possible to control only the phase. Accordingly, upon the transmission, it is not necessary to convert the analog transmitting signals into any digital signals, however, the phase of the transmitting radio signals are controlled by the phase shifters 5.

The control apparatus for the above-mentioned conventional phased array radar apparatus is principally purposed for application to radars, and therefore, the difference between the frequencies of the receiving and transmitting radio signals has not been taken into his consideration. However, in satellite communications or the like, generally speaking, the frequency of the receiving frequency is different from that of the transmitting frequency by about 10% thereof. If the above-mentioned conventional method is applied to this case as it is, the phase of the transmitting radio signal can not be adaptive controlled based on the receiving radio signal. This leads to the following disadvantageous problems: for example, (a) the main beam of radio signal can not be directed toward the desired direction; and (b) large effects of unnecessary radio waves such as interference radio waves leads to misdirection in the control apparatus.

Further, as shown in the conventional apparatus, elimination of unnecessary radio waves has been implemented only to the receiving signals. In the above-mentioned conventional radar apparatus or the like, it is necessary only to radiate a strong radio wave to the target object, namely, it is necessary only to radiate the transmitting radio signals only in the predetermined directions. However, in the satellite communications, it is necessary to receive the transmitted radio signals without any distortion, and therefore it is necessary to provide a communication line having a better signal to noise power ratio. If, upon the reception, the zero point of the radiation pattern is formed in the incoming directions of the unnecessary radio waves, it is necessary to radiate the transmitting radio signals in the same radiation pattern as that of the reception.

SUMMARY OF THE INVENTION

Accordingly, an object of the present invention is to provide an apparatus for controlling an array antenna, which is capable of adaptive controlling the radiation pattern of transmitting radio signals, even when the receiving frequency is different from the transmitting frequency.

Further, another object of the present invention is to provide a method for controlling an array antenna, which is capable of adaptive controlling the radiation pattern of transmitting radio signals, even when the receiving frequency is different from the transmitting frequency.

In order to achieve the aforementioned objective, according to one aspect of the present invention, there is provided an apparatus for controlling an array antenna including a predetermined plurality of M antenna elements arranged closely to one another in a predetermined arrangement configuration, said apparatus comprising:

multi-beam forming means for calculating beam electric field strengths of a plurality of N beams of transmitting signals, based on a receiving frequency of receiving signals, a plurality of M receiving signals respectively received by said antenna elements of said array antenna, and directions of predetermined plurality of N beams of transmitting signals to be formed, said directions having been predetermined so that a desired radio wave can be received in a predetermined range of radiation angle;

beam selecting means for comparing said plurality of N beam electric field strengths calculated by the multi-beam forming means with a predetermined threshold value, and selectively outputting signals representing said beam electric field strengths equal to or larger than said threshold value;

adaptive controlling means, based on said signals representing said beam electric field strengths outputted from said beam selecting means, for calculating a plurality of N weight coefficients for the receiving signals respectively corresponding to the plurality of N beams of transmitting signals, said weight coefficients being calculated such that a main beam of the array antenna is directed toward an incoming direction of a desired radio wave and also a level of said receiving signal in an incoming direction of an unnecessary radio wave are made zero;

calculating means, based on said plurality of N weight coefficients calculated by said adaptive controlling means and a transmitting frequency of the transmitting signals, for calculating at least either one of a plurality of M amounts of phase shift and a plurality of M amounts of amplitude for the transmitting signals, respectively corresponding to said antenna elements, such that the main beam of the array antenna is directed toward the incoming direction of the desired radio wave and also the level of the transmitting signal in the incoming direction of the unnecessary radio wave are made zero; and antenna controlling means for controlling said antenna elements of said array antenna, respectively, in accordance with at least one of said plurality of M amounts of phase shift calculated by said calculating means and said plurality of M amounts of amplitude calculated by said calculating means, thereby radiating the controlled transmitting signals from said antenna elements of said array antenna.

In the above-mentioned apparatus, said antenna controlling means comprises at least either one of:

phase shifting means for shifting phases of the transmitting signals in correspondence to said antenna elements, respectively, by said plurality of M amounts of phase shift calculated by said calculating means, and outputting the transmitting signals having the shifted phases to said antenna elements of said array antenna; and amplitude changing means for changing amplitudes of the transmitting signals in correspondence to said antenna elements, respectively, by said plurality of M amounts of amplitude calculated by said calculating means, respectively, and outputting the transmitting signals having the changed amplitudes to said antenna elements of said array antenna.

In the above-mentioned apparatus, said apparatus further comprises:

amplifying means for amplifying said signals representing said beam electric field strengths outputted from said beam selecting means, respectively, with gains proportional to said plurality of N weight coefficients calculated by said adaptive controlling means; and combining means for combining in phase said receiving signals amplified by said amplifying means, thereby outputting said combined receiving signals as a receiving signal.

Further, according to another aspect of the present invention, there is provided a method for controlling an array antenna including a predetermined plurality of M antenna elements arranged closely to one another in a predetermined arrangement configuration, said method including the following steps of:

calculating beam electric field strengths of a plurality of N beams of transmitting signals, based on a receiving frequency of receiving signals, a plurality of M receiving signals respectively received by said antenna elements of said array antenna, and directions of predetermined plurality of N beams of transmitting signals to be formed, said directions having been predetermined so that a desired radio wave can be received in a predetermined range of radiation angle;

comparing said calculated plurality of N beam electric field strengths with a predetermined threshold value, and selectively outputting signals representing said beam electric field strengths equal to or larger than said threshold value;

based on said outputted signals representing said beam electric field strengths, calculating a plurality of N weight coefficients for the receiving signals respectively corresponding to the plurality of N beams of transmitting signals, said weight coefficients being calculated such that a main beam of the array antenna is directed toward an incoming direction of a desired radio wave and also level of said receiving signal in an incoming direction of an unnecessary radio wave are made zero;

based on said calculated plurality of N weight coefficients and a transmitting frequency of the transmitting signals, calculating at least either one of a plurality of M amounts of phase shift and a plurality of M amounts of amplitudes for the transmitting signals, respectively corresponding to said antenna elements, such that the main beam of the array antenna is directed toward the incoming direction of the desired radio wave and also the level of the transmitting signal in the incoming direction of the unnecessary radio wave are made zero; and controlling said antenna elements of said array antenna, respectively, in accordance with at least one of said calculated plurality of M amounts of phase shift and said calculated plurality of M amounts of amplitude, thereby radiating the controlled transmitting signals from said antenna elements of said array antenna.

In the above-mentioned method, said controlling step includes at least either one step of the following steps:

shifting phases of the transmitting signals in correspondence to said antenna elements, respectively, by said calculated plurality of M amounts of phase shift, and outputting the transmitting signals having the shifted phases to said antenna elements of said array antenna; and changing amplitudes of the transmitting signals in correspondence to said antenna elements, respectively, by said calculated plurality of M amounts of amplitude, respectively, and outputting the transmitting signals having the changed amplitudes to said antenna elements of said array antenna.

Accordingly, the present invention has the following advantageous effects:

(1) even if the transmitting frequency ft and the receiving frequency fr is different from each other, the main beam of the array antenna can be directed toward the incoming direction of a desired radio wave and also the zero point can be formed in the incoming direction of an unnecessary radio wave such as an interference radio wave or the like, so that the reception and transmission can be implemented with the unnecessary radio waves remarkably suppressed;

(2) since the radiation pattern of the transmitting signals can be adaptive controlled as described above in the above-mentioned effect (1), the present invention allows a remarkable improvement in the signal to noise power ratio of a radio communication line so that the quality of the radio communication line can be remarkably improved as compared with that of the conventional apparatus in which only the receiving signals are adaptive controlled. Therefore, for example, in the case of a digital radio communication line, the bit error rate can be remarkably improved. Further, in particular in a mobile communication system, control of the radiation patterns of the array antenna can be performed in combination with a tracking system for transmitting signals, resulting in an improved system; and (3) in the case where only the phases of the transmitting signals are controlled in the transmission system, the composition of the control apparatus can be simplified since the amplitudes of the transmitting signals are not controlled.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Preferred embodiments according to the present invention are now described with reference to the accompanying drawings.

<First Preferred Embodiment>

Figure 1:
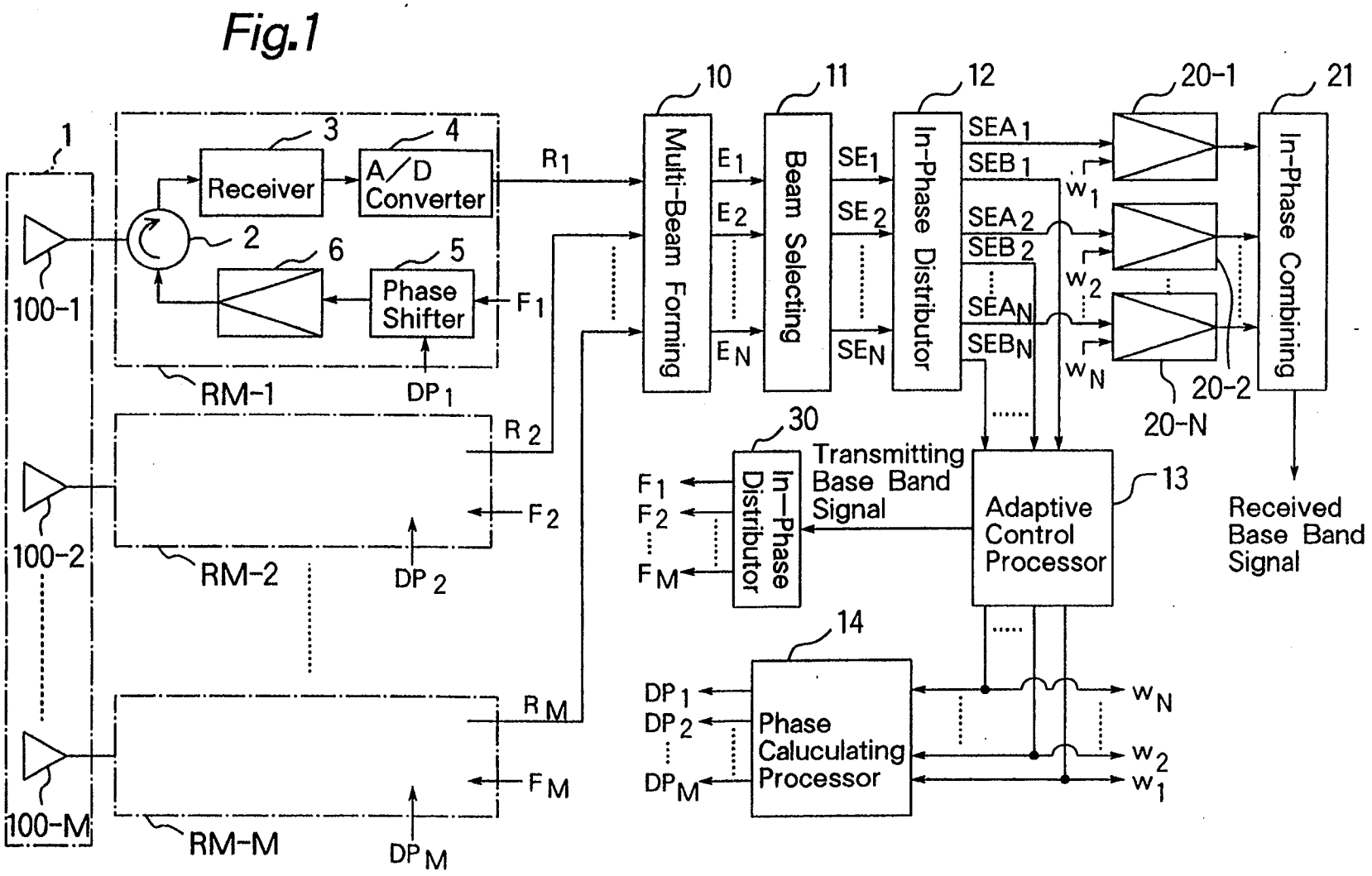
FIG. 1 is a block diagram of a control apparatus for controlling an array antenna, of a first preferred embodiment according to the present invention.
Figure 6:
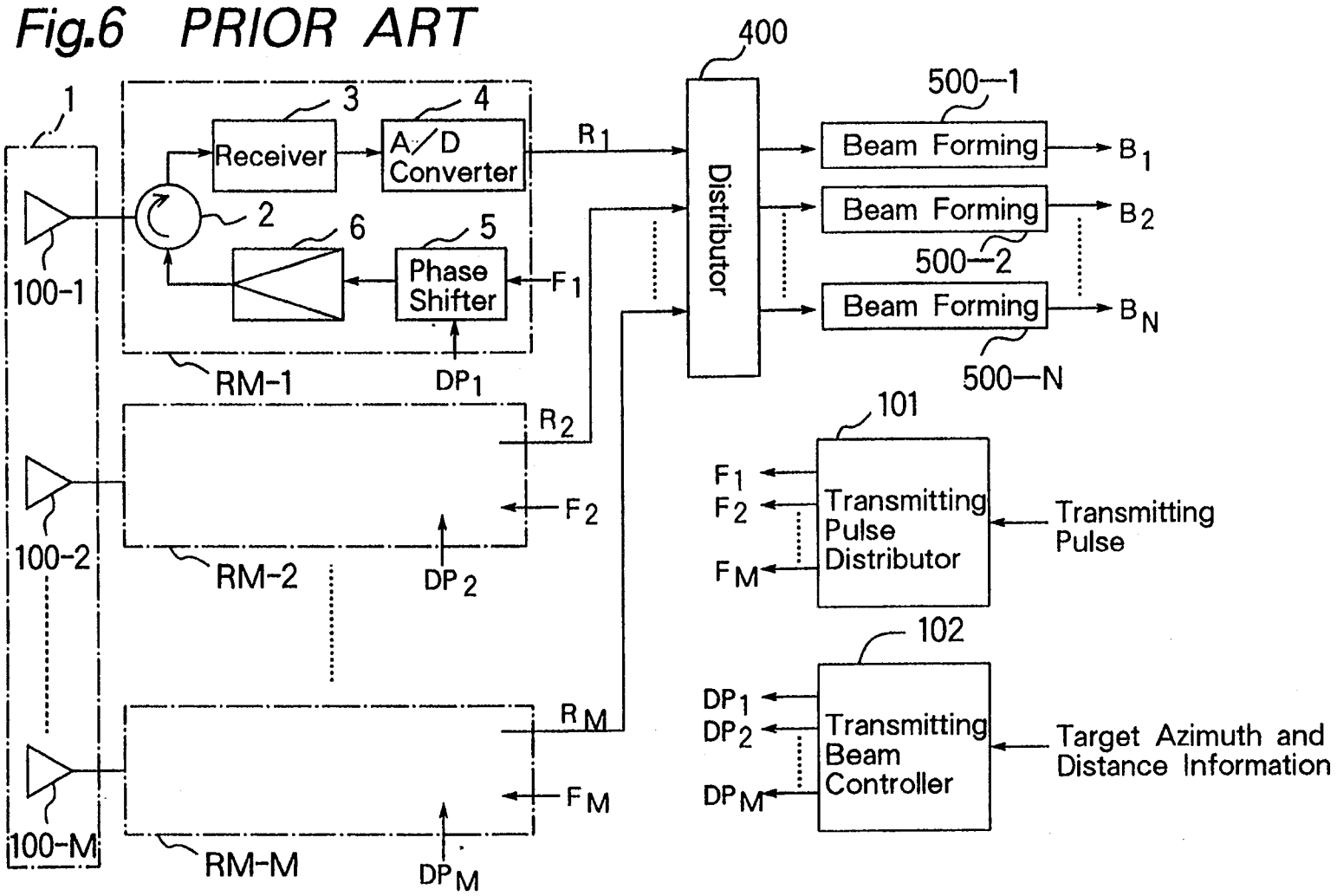
Fig.6 PRIOR ART
FIG. 6 is a block diagram of a conventional phased array radar apparatus.
Figure 7:
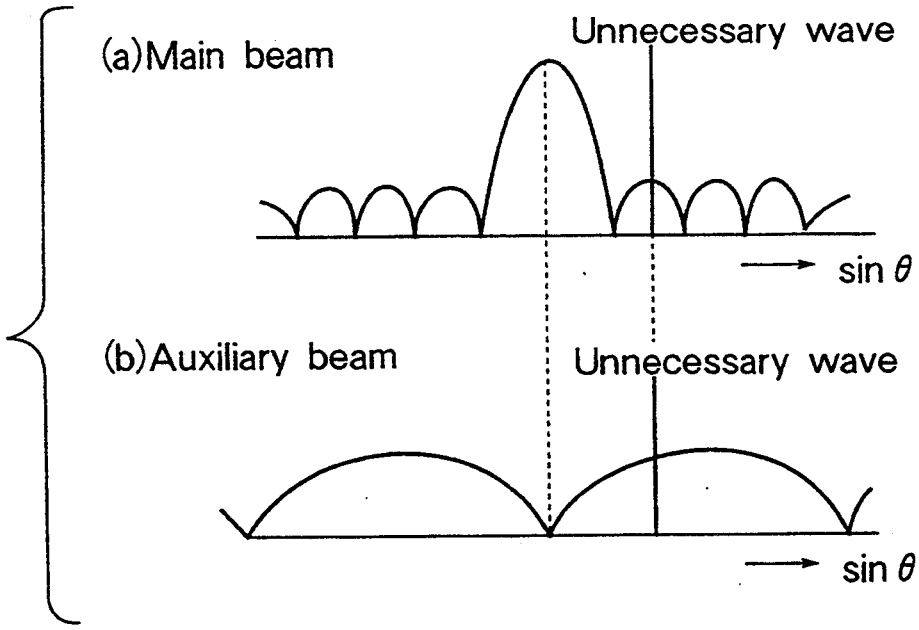
Fig.7 PRIOR ART
FIG. 7 is a view of a radiation pattern for explaining a principle of adaptive control in the phased array radar apparatus of the prior art shown in FIG. 6, wherein FIG. 7 (*a*) shows a radiation pattern of a main beam of transmitting radio signals, and FIG. 7 (*b*) shows a radiation pattern of an auxiliary beam of transmitting radio signal.
Figure 8:
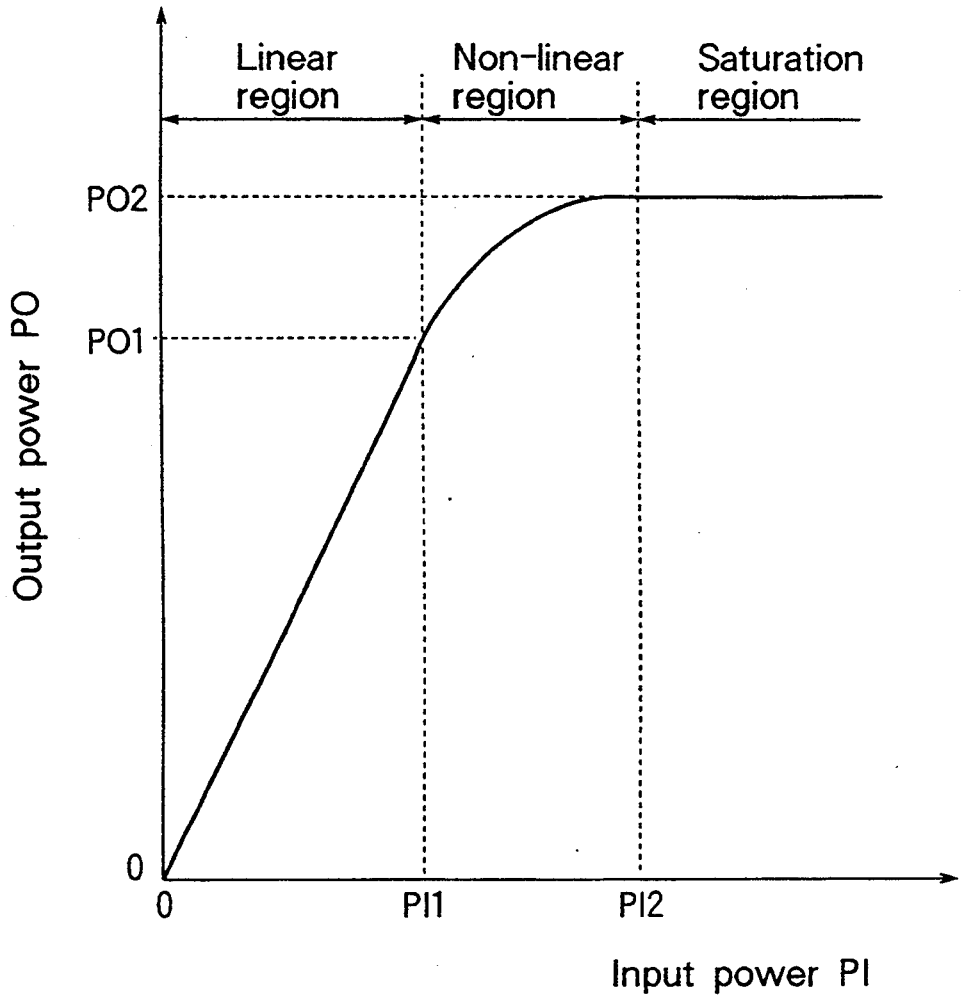
Fig.8 PRIOR ART
FIG. 8 is a graph showing input and output characteristics of a high output power amplifier of the conventional apparatus shown in FIG. 6.

FIG. 1 is a block diagram of a control apparatus for controlling an array antenna, of a first preferred embodiment according to the present invention. In FIG. 1, the same portions as those shown in FIG. 6 are designated by the same numerals as those in FIG. 6. The control apparatus of the present preferred embodiment is a control apparatus for controlling an array antenna 1, which comprises a predetermined plurality of natural number M of antenna elements 100-1 to 100-M (hereinafter, typified by 100-m), which are arrayed closely to one another in a predetermined arrangement configuration.

The control apparatus comprises, as shown in FIG. 1:

(a) a multi-beam forming circuit 10 for calculating a plurality of natural number N of beam electric field strengths $E_n$ (n=1, 2, . . . , N) and outputting a plurality of N beam electric field strength signals representing the electric field strengths $E_n$, based on the followings:

(a-1) receiving digital signals $R_1$ to $R_M$ (hereinafter, typified by $R_m$) respectively outputted from A/D converters 4 of transmission and reception modules RM-1 to RM-M (hereinafter, typified by RM-m);

(a-2) directional vectors $d_n$ representing directions of main beams of a predetermined plurality of N beams to be formed, the directions of the directional vector $d_n$ having been predetermined so that a desired radio wave can be received in a predetermined range of radiation angle; and (a-3) the receiving frequency fr of the receiving signals;

(b) a beam selecting circuit 11 for comparing the plurality of N beam electric field strength $E_n$ of the signals outputted from the multi-beam forming circuit 10 with a threshold value predetermined depending on levels of side lobes of the array antenna 1, a processing speed of an adaptive control processor 13, and the like, and then selectively outputting only the signals representing the beam electric field strengths $SE_n$ (n=1, 2, . . . , N) equal to or larger than the threshold value, wherein, however, any signal representing the beam electric field strength smaller than the threshold value is not outputted as data, alternatively, data of zero may be outputted when the beam electric field strength is smaller than the threshold value;

(c) an in-phase distributor circuit 12 for in phase dividing each of the signals representing the beam electric field strengths $SE_n$ (n=1, 2, . . . , N) outputted from the beam selecting circuit 11 into two beam electric field strength signals $SEA_n$ and $SEB_n$ having the same phase as each other, and then distributing and outputting one group of beam electric field strength signals $SEA_n$ (n=1, 2, . . . , N) and another group of beam electric field strength signals $SEB_n$ (n=1, 2, . . . , N);

(d) an adaptive control processor 13 for calculating a plurality of N weight coefficients $w_n$ (n=1, 2, . . . , N) for the receiving signals corresponding to respective beams, the weight coefficients being calculated such that the main beam of the array antenna 1 is directed toward the incoming direction of the desired radio wave and also the level of the receiving signal in an incoming direction of an unnecessary radio wave such as an interference radio wave or the like becomes zero, using e.g. a conventional constant modulus algorithm (hereinafter, referred to as a CM algorithm), based on the one group of beam electric field strength signals $SEA_n$ (n=1, 2, . . . , N) outputted from the in-phase distributor circuit 12, and for outputting signals representing the calculated plurality of N weight coefficients $w_n$ (n=1, 2, . . . , N) to a phase calculating processor 14 and variable gain amplifiers 20-1 to 20-N (hereinafter, typified by 20-n); and (e) a phase calculating processor 14 for calculating amounts of phase shift $DP_1$ to $DP_M$ (hereinafter, typified by $DP_m$) for transmitting signals corresponding to respective antenna elements 100-m, the amounts of phase shift being calculated such that the main beam of the array antenna 1 is directed toward the desired incoming direction of the desired radio wave and also the transmission level of the transmitting signal in an incoming direction of an unnecessary radio wave such as an interference radio wave or the like becomes zero, based on the plurality of N weight coefficients $w_n$ (n=1, 2, . . . , N) of the signals outputted from the adaptive control processor 13 and the transmitting frequency ft of the transmitting signals, and for outputting the calculated amounts of phase shift $DP_1$ to $DP_M$ to respective phase shifters 5 of the transmission and reception modules RM-m, respectively.

Each of the transmission and reception modules RM-m respectively connected to the antenna elements 100-m of the array antenna 1 comprise, as well as that of the conventional apparatus, a circulator 2 used as a antenna combiner for commonly using one antenna element for reception and transmission, a receiver 3 having a frequency converter and a demodulator, the A/D converter 4, the phase shifter 5 for shifting the phase of the transmitting signal by a set amount of phase shift, and a high output power amplifier 6 for amplifying and transmitting a high-frequency transmitting signal.

A transmitting base band signal is inputted to an in-phase distributor 30, which then in phase divides the inputted transmitting base band signal into a plurality of M transmitting signals $F_1$ to $F_M$ (hereinafter, typified by Fm), and outputs the same to respective phase shifters 5 of the transmission and reception modules RM-m, respectively. Each of the phase shifters 5 shifts the phase of the inputted transmitting base band signal by the amount of phase shift $DP_m$ calculated by the phase calculating processor 14, as described in detail later, and then outputs the phase-shifted signal to the antenna element 100-m of the array antenna 1 through the high output power amplifier 6 and the circulator 2, thereby radiating the transmitting signals from the antenna elements 100-m.

A receiving radio signal received by the antenna element 100 of the array antenna 1 is inputted to the receiver 3 through the circulator 2 of each of the transmission and reception modules RM-m. The receiver 3 converts the inputted receiving signal to an intermediate frequency signal having a predetermined intermediate frequency and further performs a predetermined demodulation process for the frequency-converted intermediate frequency signal, and then outputs the demodulated receiving signal through the A/D converter 4 to the multi-beam forming circuit 10 as a receiving digital signal $R_m$.

Figure 2:
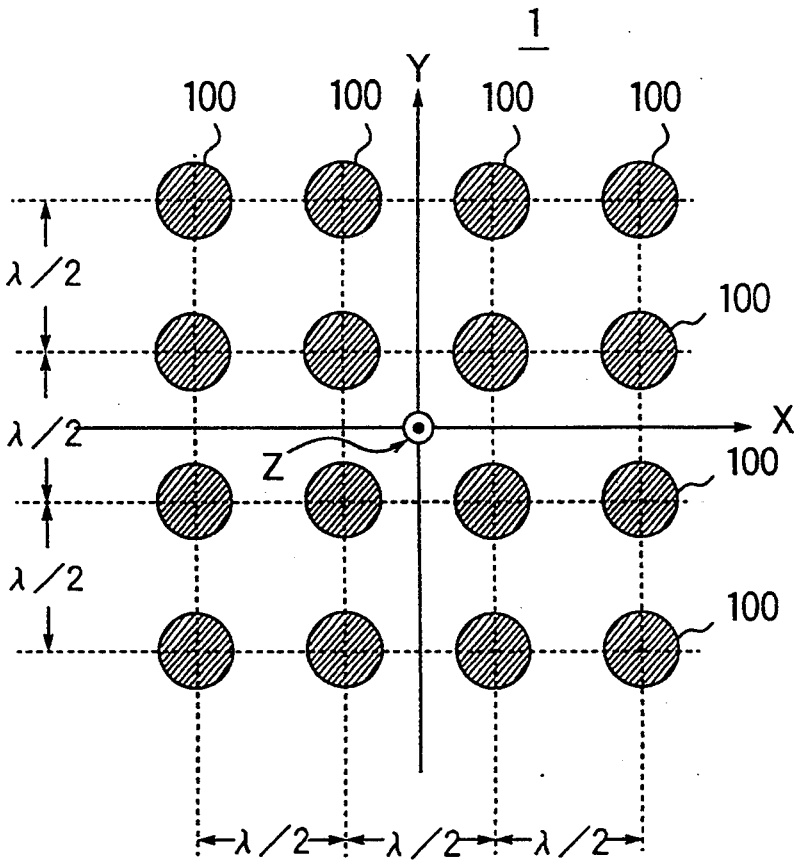
FIG. 2 is a plan view showing an example of the array antenna i of FIG. 1.
Figure 3:
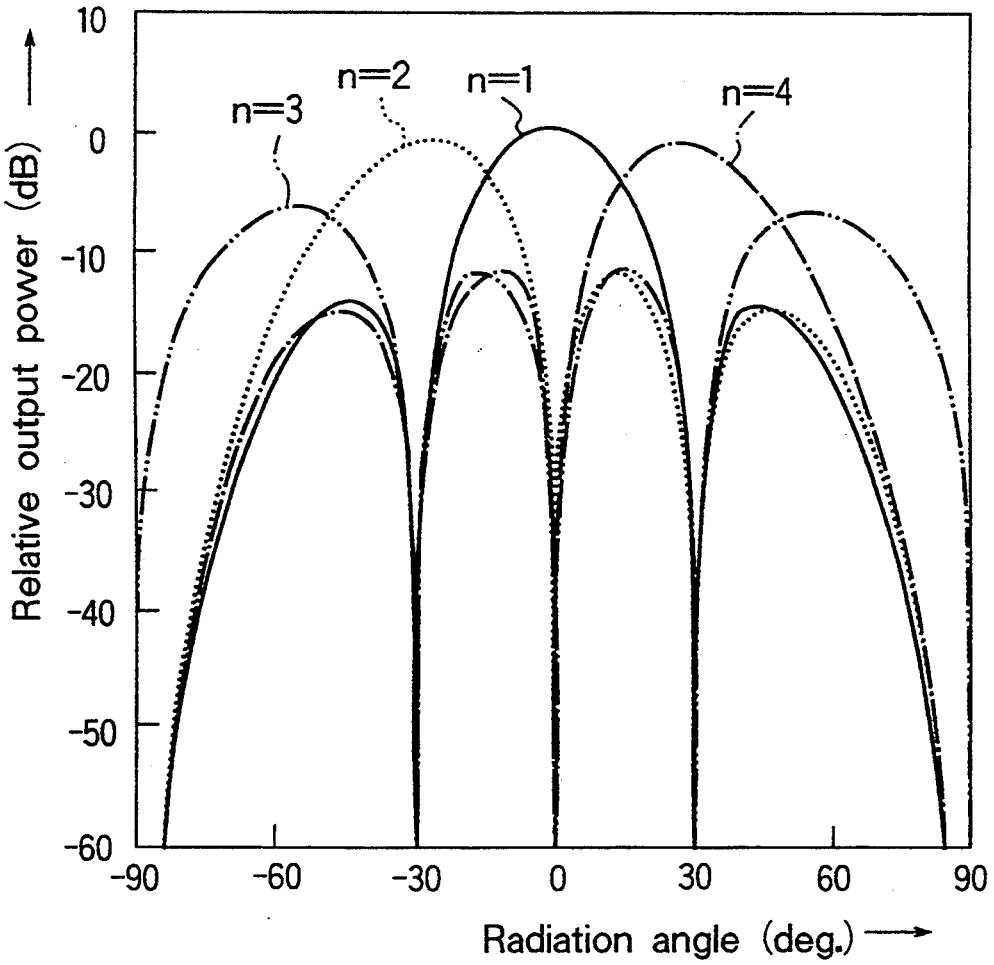
FIG. 3 is a view showing a radiation pattern of a multi-beam of radio transmitting signals radiated from the control apparatus of FIG. 1.

To the multi-beam forming circuit 10, the receiving digital signal is inputted from the A/D converter 4 of each of the transmission and reception modules RM-m, then the multi-beam forming circuit 10 calculates beam electric field strength $E_n$ of a multi-beam consisting of a plurality of N beams of signals, and further outputs the signals representing the beam electric field strengths $E_n$ of the multi-beam to the beam selecting circuit 11 in the following manner. The plurality of N directions of the beams of a multi-beam to be formed are predetermined so as to correspond to the incoming direction of the desired radio wave, where these N directions can be represented by directional vectors $d_1, d_2, \ldots, d_N$ (hereinafter, typified by $d_n$) as viewed from a predetermined origin. In this case, N is a plurality of natural number N of directional vectors $d_n$ which are set such that a desired radio wave can be received using the array antenna 1, and N is preferably set to a natural number equal to or more than 4 (such a case of N=4 is shown in FIG. 3) and is set equal to or smaller than the number M of antenna elements 100-m. When the antenna elements 100-m of the array antenna 1 are arrayed apart from each another by one half wavelength on an X-Y plane in a 4×4 matrix configuration, e.g. as shown in FIG. 2, the center of the radiation direction is located at the Z axis, where a radiation angle as described in the present preferred embodiment refers to as an angle seen from the Z axis on the X-Z plane. Further, positional vectors $r_1, r_2, \ldots, r_M$ (hereinafter, typified by $r_m$) of the antenna elements 100-m of the array antenna 1 are predetermined as directional vectors as viewed from the aforementioned predetermined origin. Then, by using the following Equation 1, the multi-beam forming circuit 10 calculates a plurality of N beam electric field strengths $E_n$ corresponding to the aforementioned directional vectors $d_n$ each directional vector represented by a combined electric field, and then outputs the signals representing the calculated N beam electric field strengths $E_n$ to the beam selecting circuit 11:

Equation 1:

$$E_n = \sum_{m=1}^{M} \exp[j(a_{nm})] \cdot R_m, \quad n = 1,2,\ldots,N$$

$$a_{am} = -(2\pi fr/c).(d_n.r_m) \qquad \text{Equation 2}$$

where c is a velocity of light, and $(d_n.r_m)$ is an inner product of a directional vector $d_n$ and a positional vector $r_m$. Therefore, the phase $a_{nm}$ is a scalar quantity.

Next, the beam selecting circuit 11 compares the plurality of N beam electric field strengths $E_n$ of the signals outputted from the multi-beam forming circuit 10 with the threshold value previously determined depending on the levels of side lobes of the array antenna 1, the processing speed of the adaptive control processor 13, and the like, and then outputs only the signals representing the beam electric field strengths $SE_n$ (n=1, 2, . . . , N) equal to or larger than the threshold value to the in-phase distributor circuit 12. On the other hand, any signal representing the beam electric field strength smaller than is not outputted as data to the in-phase distributor circuit 12. Alternatively, when the beam electric field strength is smaller than the threshold value, data of zero may be outputted.

It is to be noted that the beam selecting circuit 11 is provided for eliminating the receiving signals representing extremely small level and extremely low signal to noise power ratio.

Further, the in-phase distributor circuit 12 in-phase divides each of the beam electric field strength signal $SE_n$ (n=1, 2, . . . , N) outputted from the beam selecting circuit 11 into the two beam electric field strength signals $SEA_n$ and $SEB_n$ (n=1, 2, . . . , N), and then distributes and outputs one group of electric field strength signals $SEA_n$ (n=1, 2, . . . , N) to the adaptive control processor 13, and further outputs another group of beam electric field strength signals $SEB_n$ (n=1, 2, . . . , N) to an in-phase combiner 21 through the variable gain amplifiers 20-1 to 20-N (hereinafter, typified by 20) which amplify the inputted receiving signals with gains respectively corresponding to the weight coefficients $w_n$ of the receiving signals calculated by the adaptive control processor 13. Subsequently, the in-phase combiner 21 combines the inputted plurality of N receiving signals in phase, and then outputs the combined receiving signal as a receiving base band signal.

On the other hand, the adaptive control processor 13 calculates a plurality of such N weight coefficients $w_n$ (n=1, 2, . . . , N) such that the main beam of the array antenna 1 is directed toward the desired direction of the desired radio wave and also the reception level of the receiving signal in the incoming direction of the unnecessary radio wave such as the interference radio wave or the like becomes zero, using e.g. the above-mentioned conventional CM algorithm (for details, See e.g., Takeo Ohkane et al., "Selective phasing compensation characteristics of CMA adaptive arrays in land mobile communications," Proceedings of the Institute of the Electronics, Information and Communication Engineers, Japan, Vol. J73 - B - II, No. 10, pp. 489–497), based on the one group of beam electric field strength signals $SEA_n$ (n=1, 2, . . . , N) outputted from the in-phase distributor circuit 12, in the following manner.

That is, in the above-mentioned CM algorithm, as described below, in a communication system using a signal radio wave of a desired radio wave whose envelope has been already known, the reception level of the receiving signal in the radiation pattern of the array antenna 1 in the incoming direction of the unnecessary radio wave is made zero by converting the waveform of the envelope which may be changed by the effect of the unnecessary radio wave such as the interference radio wave or the like into a desired shape.

Now assume that a receiving signal of the n-th beam at a time t is $X_n^t$ (n=1, 2, . . . , N) and also that a complex weight coefficient to be applied to the receiving signal $X_n^t$ is $w_n^t$. In this case, a combined electric field Y combined by using the array antenna 1 can be represented by the following Equation 3:

Equation 3:

$$Y = \sum_{n=1}^{N} W_n^t \cdot X_n^t$$

If a desired shape of the envelope of the signal radio wave is assumed to be a predetermined constant value $P_0$ for simplicity, then determining the complex weight coefficient $w_n^t$ to set the envelope of the signal of the combined electric field to the constant value $P_0$ is, as is well known to those skilled in the art, equivalent to determining a complex weight coefficient $w_n^t$ which minimizes an evaluation function F as represented by the following Equations 4 and 5:

$$F = (|Y|^2 - P_0)^2 \qquad \text{Equation 4}$$

where if the combined electric field Y represented by the Equation 3 is substituted into the Equation 4, then the following Equation 5 is obtained:

Equation 5:

$$F = \left( \left| \sum_{n=1}^{N} w_n \cdot X_n \right|^2 - P_0 \right)^2$$

Therefore, calculation of a receiving signal $X_n^{(t+1)}$ at the succeeding time with the complex weight coefficient $w_n^t$ updated to a succeeding-time weight coefficient $w_n^{(t+1)}$ according to the following Equation 6 leads to that the envelope of the signal radio wave can be formed into a desired shape, and then the reception level of the radiation pattern in the incoming direction of the unnecessary radio wave can be made zero:

$$W_n^{(t+1)}=w_n^t-\mu X_n^*.(|Y|^2-P_0).Y \quad \text{Equation 6}$$

where $\mu$ is a constant determined by the communication system, and $X_n^*$ is a conjugate complex number of the receiving signal $X_n$ represented in complex number.

It is to be noted that, when the above-mentioned CM algorithm is used, as is well known to those skilled in the art, a number of zero points can be formed wherein the number of the zero points is a number obtained by subtracting one from the number of beams of the multi-beam, in the radiation pattern.

As described above, the adaptive control processor 13 calculates a plurality of N weight coefficients $w_n$ (n=1, 2, . . . , N) for receiving signals corresponding to respective beams, the weight coefficients being calculated such that the main beam of the array antenna 1 is directed toward the desired direction of the desired radio wave and also the reception level of the receiving signal in the incoming direction of the unnecessary radio wave such as the interference radio wave or the like is made zero, using the CM algorithm based on the beam electric field strength signals $SEA_n$ (n=1, 2, . . . , N) outputted from the in-phase distributor circuit 12, and then outputs signals representing a plurality of N weight coefficients $w_n$ (n=1, 2, . . . , N) to the phase calculating processor 14 and the variable gain amplifiers 20.

Further, the phase calculating processor 14 calculates such amounts of phase shift $DP_m$ for the receiving signals corresponding to the antenna elements 100-m that the main beam of the array antenna 1 is directed toward the desired direction of the desired radio wave and also the transmission level of the transmitting signal in the incoming direction of the unnecessary radio wave such as the interference radio wave or the like is made zero, based on the plurality of N weight coefficients $w_n$ (n=1, 2, . . . , N) of the signals outputted From the adaptive control processor 13, and then outputs the signals representing the calculated amounts of phase shift $DP_m$ to the phase shifters 5 of respective transmission and reception modules RM-m, respectively, in the following manner. That is, the phase calculating processor 14 calculates the weight coefficients $wb_m$ to be given to the receiving signals received by the antenna elements 100-m of the array antenna 1, by multiplying the weight coefficients for the receiving signals respectively by weight coefficients corresponding to the directional vectors $d_n$ for formation of a multi-beam and calculating the sum of the products thereof with respect to all the directional vectors, using the following Equation 7:

$$wb_m = \sum_{n=1}^{N} w_n \cdot \exp[-j(2\pi \cdot fr/c) \cdot (d_n \cdot r_m)],$$

$$m = 1,2, \ldots ,M$$

In the Equation 7, if the receiving frequency fr is replaced with the transmitting frequency ft, the main beam can be directed toward the radiation direction of the desired radio wave even upon the transmission, and then further there can be obtained a radiation pattern of the transmitting signals in which the zero point is formed in the incoming direction of the unnecessary radio wave. This principle is described in more detail below.

Figure 5:
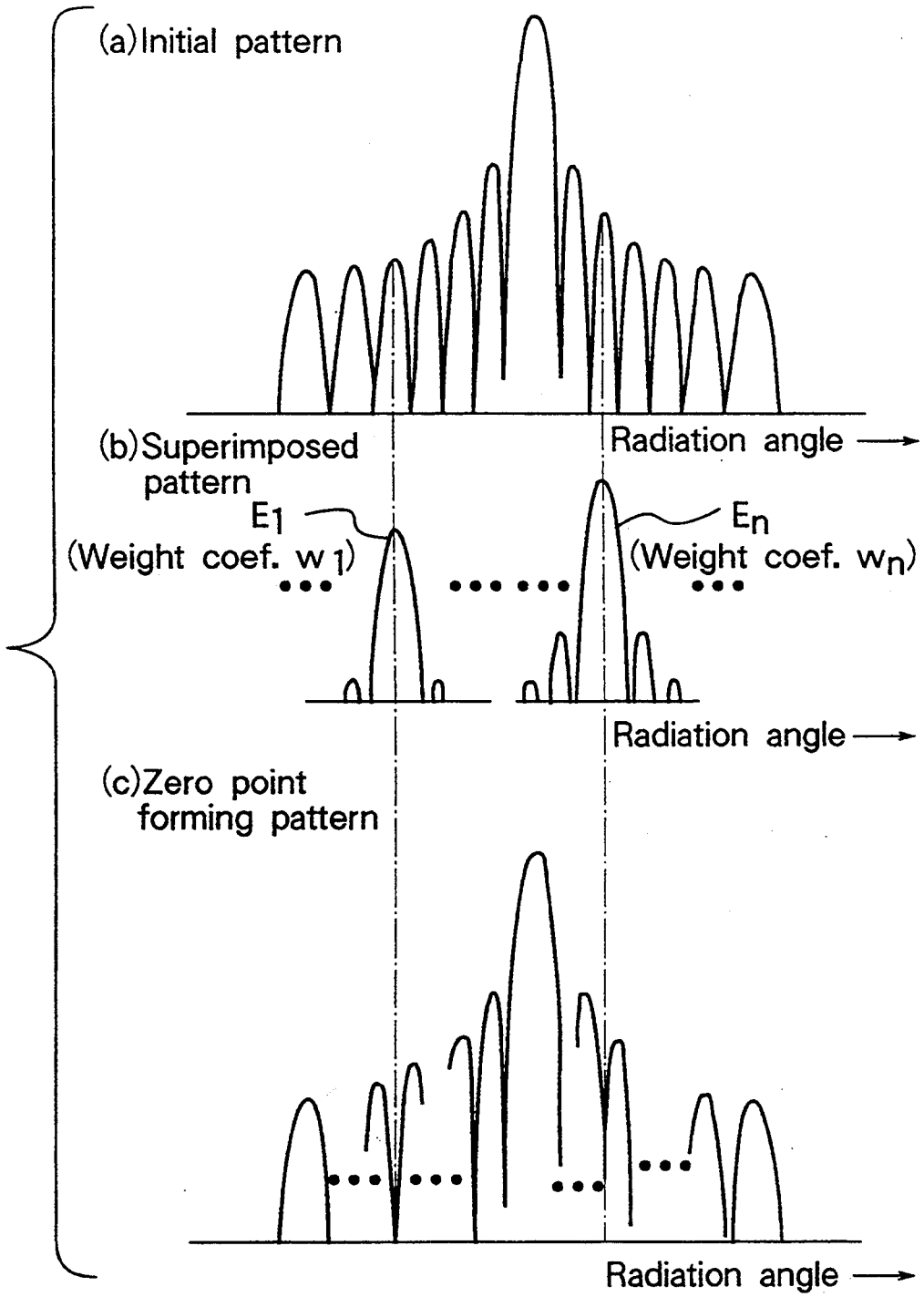
FIG. 5 is a view of a radiation pattern for explaining a principle of superimposition of beams in the control apparatus of FIG. 1, wherein FIG. 5 (*a*) shows an initial pattern, FIG. 5 (*b*) shows a superimposed pattern, and FIG. 5 (*c*) shows a zero-point forming pattern.

FIG. 5 (*a*) shows an initial radiation pattern prior to the adaptive control of the adaptive control processor 13 when the main beam of radio signal is directed toward the radiation direction of the desired radio wave in the reception. The initial radiation pattern can be obtained by multiplying the plurality of beams $E_1$, $E_2$, . . . , $E_N$ as shown in FIG. 5 (*b*) by weight coefficients $w_1$, $w_2$, . . . , $w_N$ respectively corresponding to the receiving signals and calculating the sum of the products thereof, thereby attaining a superimposed pattern. Further, by multiplying the beam electric field strengths $E_n$ respectively by the weight coefficients $w_n$ for the receiving signals calculated by the adaptive control processor 13 for the initial radiation pattern of FIG. 5 (*a*), i.e. by amplifying the receiving signals respectively by the gains proportional to the weight coefficients $w_n$ by the variable gain amplifiers 20, there can be obtained a desired receiving signal obtained when the main beam od radio signal can be directed toward the incoming direction of the desired radio wave, and further the unnecessary radio wave such as the interference radio wave or the like can be suppressed.

In this case, since the direction of the radio station of the destination to communicate, which is the incoming direction of the desired radio wave, is the direction in which transmitting signals are to be radiated, it is necessary to control the direction of the transmitting radio signal such that the transmitting radio signal is not transmitted in the incoming direction of the unnecessary radio wave such as the interference radio wave or the like. Therefore, the radiation pattern of the transmitting signals becomes similar to that of the receiving signals. Even if the receiving frequency fr and the transmitting frequency ft are different from each other, it is possible to obtain such a radiation pattern for the transmitting signals that the main beam of the transmitting signals is directed toward the incoming direction of the desired radio wave and also the zero point of the radiation pattern for the transmitting signals is formed in the incoming direction of the unnecessary radio wave such as the interference radio wave or the like, by multiplying the main beam in the same direction as in the receiving signals by the weight coefficients $w_n$ for the receiving signals, thereby superimposing the pattern representing the weight coefficients $w_n$ on the main beam of the transmitting signal. Therefore, by replacing the receiving frequency fr in the Equation 7 with the transmitting frequency ft and thereafter calculating the resulting phase, the following Equation 8 can be obtained, the particular features of the present preferred embodiment is that the radiation pattern of the transmitting signals can be obtained by controlling only the phase with respect to the transmitting signals from the reasons as described in detail later:

$$Dp_m=\tan^{-1}[Im(Z_m)/Re(Z_m)],\ m=1,2, \ldots , M \quad \text{Equation 8}$$

where a complex number $Z_m$ is:

Equation 9:

$$Z_m = \sum_{n=1}^{N} w_n \cdot \exp[-j(2\pi \cdot ft/c) \cdot (d_n \cdot r_m)]),$$

$$m = 1,2, \ldots ,M$$

where Re ($Z_m$) is a real component of the complex number $Z_m$, and Im ($Z_m$) is a pure imaginary component of the complex number $Z_m$.

The phase calculating processor 14 calculates the amounts of phase shift $DP_m$ for the transmitting signals, using the Equation 8 based on the weight coefficients $wb_m$ for the receiving signals calculated by the adaptive control processor 13, and then outputs signals representing the calculated amounts of phase shift $DP_m$ to the phase shifters 5 of the transmission and reception modules RM-m, respectively. In response to the calculated amount of phase shift $DP_m$, each of the phase shifters 5 shifts the transmitting signal by the amount of phase shift $DP_m$ calculated by the phase calculating processor 14, and then outputs the phase-shifted transmitting signal to the antenna elements 100-m of the array antenna 1 through the high output power amplifier 6 and the circulator 2, thereby radiating the transmitting signal. The radiation pattern of these transmitting signals radiated in this case is such a radiation pattern that the main beam of the transmitting signals is directed toward the incoming direction of the desired radio wave and also the zero point of the radiation pattern of the transmitting signals is formed in the incoming direction of the unnecessary radio wave such as the interference radio wave or the like.

Further, by controlling only the phase of the transmitting signals, such a radiation pattern can be obtained that the main beam of the transmitting signals is directed toward the incoming direction of the desired radio wave and also the zero point of the radiation pattern of the transmitting signals is formed in the incoming direction of the unnecessary radio wave such as the interference radio wave or the like. The reason of this is described in detail hereinafter.

First of all, an initial combined electric field strength $E_0$ prior to the adaptive control in a radiation pattern of a transmitting signal $F_m$ can be represented by the following Equation 10:

$$E_0 = \sum_{m=1}^{M} F_m$$

Then, assuming that complex driving values $A_m$ for forming the zero point in the radiation pattern of the transmitting signals $F_m$ can be represented, with the amplitude changes (each is a real value) of the complex driving values $A_m$ being $\Delta a_{0m}$ and its phase changes (each is a real value) being $\Delta\phi_m$, as the following Equation 11:

$$A_m=(1+\Delta a_{0m})\exp(j\Delta\phi_m).F_m,\ m=1,2,\ldots,M$$

The combined electric field strength can be represented by the following Equation 12 when the zero point is formed in the radiation pattern of the transmitting signal:

Equation 12:

$$\sum_{m=1}^{M} (1+\Delta a_{0m})\exp(j\Delta\phi_m)\cdot F_m = 0$$

An error combined electric field strength Eep from the initial combined field when only the drive phase of the transmitting signal is set to $\Delta\phi_m$ in the above-mentioned Equation 12 can be represented by the following.

Equation 13:

-continued $$Eep = \sum_{M=1}^{M} \Delta a_{0m}\cdot\exp(j\Delta\phi_m)\cdot F_m$$

In this case, in order to form the zero point in the side lobe region in the radiation pattern of the transmitting signal, the following equations 14 and 15 should hold:

$$\exp(j\Delta\phi_m)=1+j\Delta\phi_m \qquad \text{Equation 14}$$

$$\Delta a_{0m}.\Delta\phi_m << 1 \qquad \text{Equation 15}$$

If the conditions of the above-mentioned Equations 14 and 15 are substituted into the Equation 13, then the following Equation 16 is obtained:

Equation 16:

$$Eep \approx \sum_{m=1}^{M} \Delta a_{0m}\cdot F_m$$

Further, since the amplitude changes of the complex driving values generally holds $\delta a_{0m} << 1$, applying this condition to the Equation 16 results in the error combined electric field strength $Eep << 1$. This facts means that, by controlling only the phase of the transmitting signals, such a radiation pattern of the transmitting signals can be obtained that the main beam of the transmitting signals is directed toward the incoming direction of the desired radio wave and also the zero point of the radiation pattern of the transmitting signals is formed in the incoming direction of the unnecessary radio wave such as the interference radio wave or the like.

Described below are calculation results of a simulation performed by the present inventors in order to verify the effects of the present first preferred embodiment in the transmission using the control apparatus for controlling the array antenna of the first preferred embodiment as described in detail above.

For example, a radiation pattern of a four-element multi-beam in the horizontal direction parallel to the Z-axis is shown in FIG. 3, the radiation pattern being formed by the multi-beam forming circuit 10 when the array antenna 1 shown in FIG. 1 is arranged in a form of 4×4 matrix array as shown in FIG. 2. In this case, the radiation angle $\theta$ of the main beam of respective radiation patterns is as follows:

(a) the radiation pattern for n=1 (shown by a solid line): $\theta=0°$;

(b) radiation pattern for n=2 (shown by a dotted line): $\theta=-30°$;

(c) radiation pattern for n=3 (shown by a two-dotted chain line): $\theta=-50°$; and (d) radiation pattern for n=4 (shown by a one-dotted chain line): $\theta=-50°$.

As apparent from FIG. 3, it can be understood that, the main beam of the receiving signals in the array antenna 1 can be directed toward the direction of the desired radio wave in at least four radiation patterns over the range of radiation angle $\theta$ from $-90°$ to $+90°$.

Figure 4:
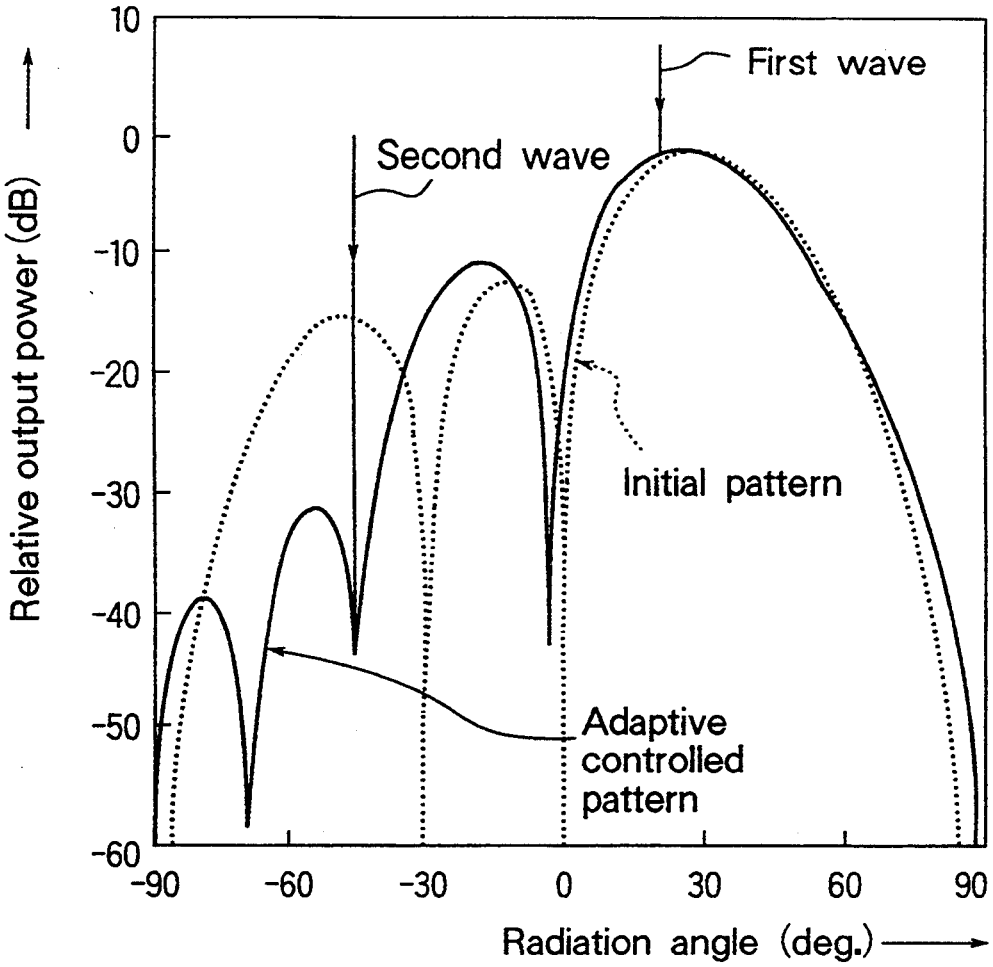
FIG. 4 is a view showing a radiation pattern adaptive controlled for reception in the control apparatus of FIG. 1.

Next, shown in FIG. 4 is a radiation pattern obtained when the internal noise of the reception system is at a level of $-20$ dB (relative power when the receiving power of the first radio wave is set as 0 dB) and in the case where, after receiving the first radio wave from the radio station of the destination to be transmitted in an environment as shown in Table 1, the second radio wave coming as a result of the first radio wave's being reflected by another object is received.

TABLE 1

| Type of signal wave | Received relative power (dB) | Radiation Angle (°) | Delay time |
|---|---|---|---|
| First wave | 0 | 20 | 0 |
| Second wave | −3 | −45 | 1.6 |

(Notes:
The unit of the delay time is one time slot of the transmission signal.)

Referring to FIG. 4, the dotted line shows the radiation pattern of color, and further the solid line shows the radiation pattern after the adaptive control when the adaptive control is effected by the control apparatus of the present preferred embodiment. As is apparent from FIG. 4, the initial radiation pattern shows a greater electric field strength at the radiation angle of the second radio wave, whereas the radiation pattern after the adaptive control shows a remarkably lowered electric field strength, thereby forming the zero point at the radiation angle of the second radio wave. In other words, it can be understood that the main beam is directed toward the first radio wave which is the desired radio wave, and further a zero point is formed in the incoming direction of the second radio wave which is the unnecessary radio wave, thus the second radio wave having been remarkably suppressed.

Therefore, the present preferred embodiment has the following advantageous effects:

(1) even if the transmitting frequency ft and the receiving frequency fr is different from each other, the main beam of the array antenna 1 can be directed toward the incoming direction of a desired radio wave and the zero point can be formed in the incoming direction of an unnecessary radio wave such as an interference radio wave or the like, so that the reception and transmission can be implemented with the unnecessary radio waves remarkably suppressed;

(2) since the radiation pattern of the transmitting signals can be adaptive controlled as described above in the above-mentioned effect (1), the present preferred embodiment allows a remarkable improvement in the signal to noise power ratio of a radio communication line so that the quality of the radio communication line can be remarkably improved as compared with that of the conventional apparatus in which only the receiving signals are adaptive controlled. Therefore, for example, in the case of a digital radio communication line, the bit error rate can be remarkably improved. Further, in particular in a mobile communication system, control of the radiation patterns of the array antenna 1 can be performed in combination with a tracking system for transmitting signals, resulting in an improved system; and (3) since, in a transmission system, only the phases not the amplitudes of the transmitting signals are controlled, the composition of the control apparatus can be simplified.

<Second Preferred Embodiment>

Figure 9:
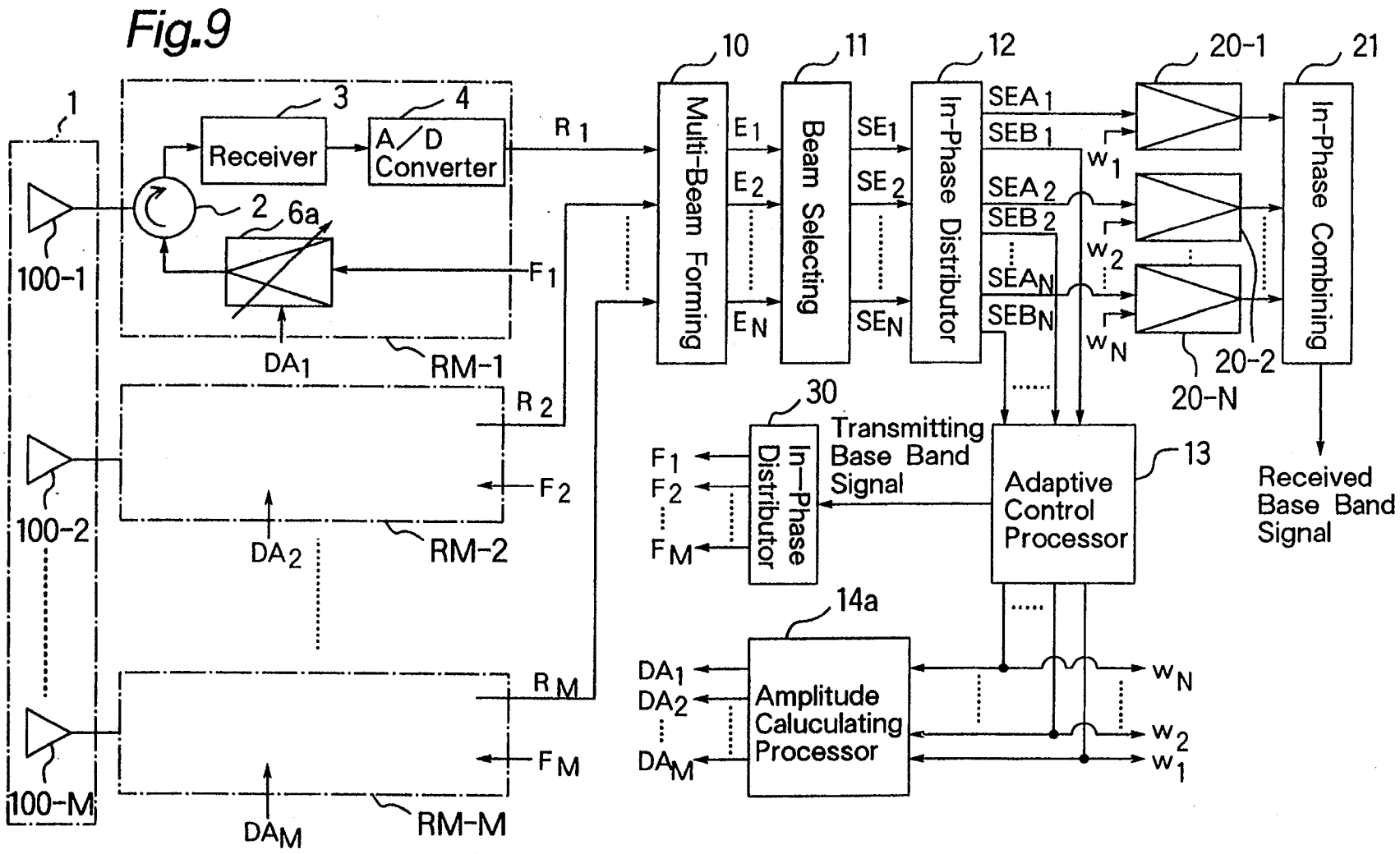
FIG. 9 is a block diagram of a control apparatus for controlling an array antenna, of a second preferred embodiment according to the present invention.

FIG. 9 is a block diagram of a control apparatus for controlling an array antenna, of a second preferred embodiment according to the present invention. In FIG. 9, the same portions as those shown in FIG. 1 are designated by the same numerals as those shown in FIG. 1. As shown in FIG. 9, the control apparatus of the present second preferred embodiment differs from the first preferred embodiment shown in FIG. 1 in the following points:

(a) an amplitude calculating processor 14*a* is provided instead of the phase calculating processor 14;

(b) in the transmission and reception modules RM-m, an amplitude changeable or variable gain type high output power amplifier 6*a* having an amplitude gain which can be changed in accordance with amplitude data $DA_1$ to $DA_M$ is used instead of the high output power amplifier 6; and (c) in the transmission and reception modules RM-m, the phase shifter 5 is not provided but a plurality of M transmitting signals $F_1$ to $F_M$ outputted from the in-phase distributor 30 are inputted directly to the amplitude changeable type high output power amplifiers 6*a*, respectively. These differences between the first and second preferred embodiments are described in detail hereinafter.

The features of the second preferred embodiment are as follows. In order to obtain such a radiation pattern for transmitting signals that the main beam of transmitting signals is directed toward the incoming direction of a desired radio wave and also the zero point of the radiation pattern of the transmitting signals is formed in the incoming direction of an unnecessary radio wave such as an interference radio wave or the like, the radiation pattern is obtained by controlling only the amplitudes of the transmitting signals in accordance with the amounts of amplitude $DA_m$ on the right side of the Equation 9 (See the following Equation 17) without changing the phases of the transmitting signals:

$$DA_m = |Z_m|,\ m=1,2,\ldots,M \qquad \text{Equation 17}$$

The amplitude calculating processor 14*a* calculates amounts of the amplitudes $DA_m$ for the transmitting signals using the above-mentioned Equation 17, based on the weight coefficients $wb_m$ for the receiving signals calculated by the adaptive control processor 13, and outputs signals representing the calculated amounts of the amplitudes $DA_m$ for the transmitting signals to respective amplitude changeable type high output power amplifiers 6*a* of the transmission and reception modules RM-m, respectively. In response to the signals representing the calculated amounts of the amplitudes $DA_m$, the amplitude changeable type high output power amplifiers 6*a* respectively amplify the transmitting signals $F_1$ to $F_M$ outputted from the in-phase distributor 30 so that the amplitudes of respective transmitting signals $F_1$ to $F_M$ are changed so as to set to the calculated amounts of amplitude $DA_m$, and thereafter respectively output the amplified transmitting signals to the antenna elements 100-m of the array antenna 1 through the circulator 2, thereby radiating the transmitting signals from respective antenna elements 100-m of the array antenna 1. In this case, the radiation pattern of the transmitting signals radiated is such a radiation pattern that the main beam of the transmitting signal is directed toward the incoming direction of the desired radio wave and also the zero point of the radiation pattern of the transmitting signals is formed in the incoming direction of the unnecessary radio wave such as the interference radio wave or the like.

Further, below described is the reason why such a radiation pattern of the transmitting signals, that the main beam of the transmitting signals is directed toward the incoming direction of the desired radio wave and also the zero point of the radiation pattern of the transmitting signals is formed in the incoming direction of the unnecessary radio wave such as the interference radio wave or the like, can be obtained by controlling only the amplitudes of the transmitting signals without controlling the phases of the transmitting signals.

First of all, an initial combined electric field strength $E_0$ prior to the adaptive control in the radiation pattern of the transmitting signals $F_m$ can be represented by the above-mentioned Equation 10. Then, if the complex driving values $A_m$ for forming the zero point in the radiation pattern of the transmitting signals $F_m$ are represented by the above-mentioned Equation 11 with the amplitude changes (each is a real value) of the complex driving values $A_m$ being $\Delta a_{0m}$ and the phase changes (each is a real value) thereof being $\Delta\Phi_m$, then the combined electric field strength when the zero point is formed in the radiation pattern of the transmitting signals can be represented by the above-mentioned Equation 12. Further, the error combined electric field strength Eea from the initial combined field when only each of the drive amplitudes of the transmitting signals is set to $(1+\Delta a_{0m})$ in the Equation 12 can be represented by the following Equation 18:

$$Eea = \sum_{m=1}^{M} (1 + \Delta a_{0m}) \cdot \exp(j\Delta\phi_m) \cdot F_m - \sum_{m=1}^{M} (1 + \Delta a_{0m}) \cdot F_m \approx \sum_{M=1}^{M} (1 + \Delta a_{0m}) \cdot F_m \cdot (1 + j\Delta\phi_m - 1) = \sum_{m=1}^{M} (1 + \Delta a_{0m}) \cdot F_m \cdot j\Delta\phi_m$$

In this case, on the assumption that the above-mentioned Equation 15 holds, if the condition of the above Equation 15 ($\Delta a_{0m}.\Delta\phi_m << 1$) is substituted into the Equation 18, then the following Equation 19 is obtained:

Equation 19:

$$Eea \approx \sum_{m=1}^{M} \Delta\phi_m \cdot F_m$$

Further, since the phase changes of the complex driving values generally hold $\Delta\phi m << 1$, applying this conditions to the Equation 19 leads to the error combined electric field strength $Eea << 1$. This means that, by controlling only the amplitudes of the transmitting signals, such a radiation pattern of the transmitting signals can be obtained that the main beam of the transmitting signals is directed toward the incoming direction of the desired radio wave and also the zero point of the radiation pattern of the transmitting signals is formed in the incoming direction of the unnecessary radio wave such as the interference radio wave or the like. Accordingly, the second preferred embodiment also has the same advantageous effects as those of the first preferred embodiment.

<Third Preferred Embodiment>

Figure 10:
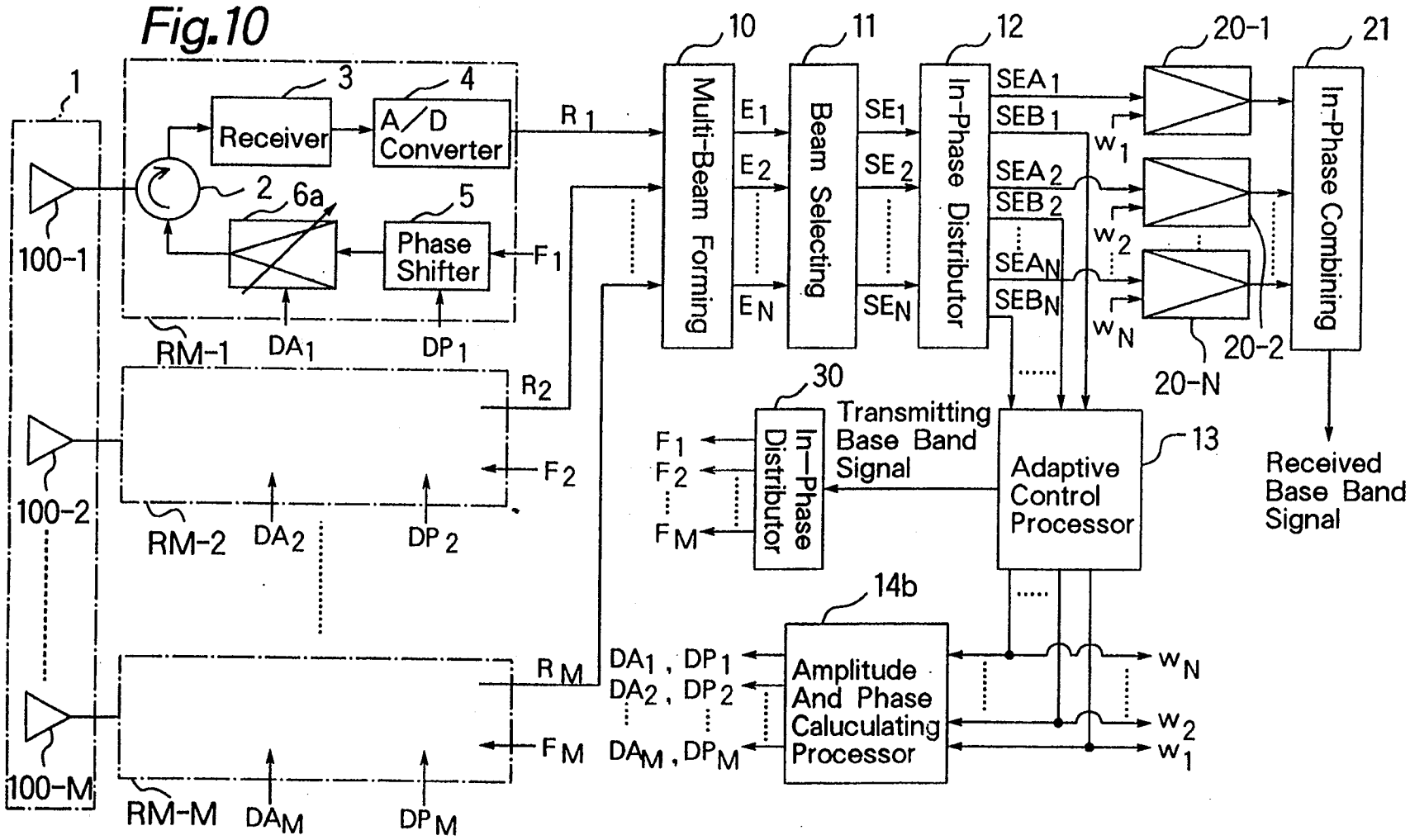
FIG. 10 is a block diagram of a control apparatus for controlling an array antenna, of a third preferred embodiment according to the present invention.

FIG. 10 is a block diagram of a control apparatus for controlling an array antenna, of a third preferred embodiment according to the present invention. In FIG. 10, the same portions as those shown in FIG. 1 are designated by the same numerals as those shown in FIG. 1. As shown in FIG. 10, the control apparatus of the present third preferred embodiment differs from the first preferred embodiment of FIG. 1 in the following points:

(a) an amplitude and phase calculating processor **14*b* is provided instead of the phase calculating processor 14; and (b) in the transmission and reception modules RM-m, the amplitude changeable type high output power amplifier 6*a* similar to that of the second preferred embodiment is used instead of the high output power amplifier 6**. These differences between the first and third preferred embodiments are described in detail below.

The features of the third preferred embodiment are as follows. In order to obtain such a radiation pattern for the transmitting signals that the main beam of the transmitting signals is directed toward the incoming direction of the desired radio wave and also the zero point of the radiation pattern of the transmitting signals is formed in the incoming direction of the unnecessary radio wave such as the interference radio wave or the like, the radiation pattern for the transmitting signals is obtained by controlling both of the amplitudes and phases of the transmitting signals in accordance with the amounts of amplitude $DA_m$ calculated by the Equation 17 and the amounts of phase shift $DP_m$ calculated by the Equation 8.

The amplitude and phase calculating processor **14*b* calculates the amounts of amplitude $DA_m$ for the transmitting signals using the Equation 17, based on the weight coefficients $wb_m$ for the receiving signals calculated by the adaptive control processor 13, and then outputs signals representing the calculated amounts of amplitude $DA_m$ to the amplitude changeable type high output power amplifiers 6*a* of the transmission and reception modules RM-m, respectively. Further, the amplitude and phase calculating processor 14*b* calculates the amounts of phase shift $DP_m$ of the transmitting signals using the Equation 8, and then outputs signals representing the calculated amounts of phase shift $DP_m$ to the phase shifters 5 of the transmission and reception modules RM-m, respectively. In response to the calculated these data outputted from the amplitude and phase calculating processor 14*b*, the amplifier 6*a* operates in a manner similar to that of the second preferred embodiment, while the phase shifter 5 operates in a manner similar to that of the first preferred embodiment. Accordingly, the transmitting signals $F_1$ to $F_M$ are respectively outputted to the antenna elements 100-m of the array antenna 1 through the phase shifters 5, the amplifiers 6*a* and the circulators 2, thereby radiating the transmitting signals from the antenna elements 100-m of the array antenna 1**. In this case, the radiation pattern of the transmitting signals radiated is such ones that the main beam of the transmitting signals is directed toward the incoming direction of the desired radio wave and also the zero point of the radiation pattern of the transmitting signals is formed in the incoming direction of the unnecessary radio wave such as the interference radio wave or the like. Further, the error combined electric field strength Ee in the third preferred embodiment corresponding to the error combined electric field strengths Eep and Eea becomes zero.

Figure 11:
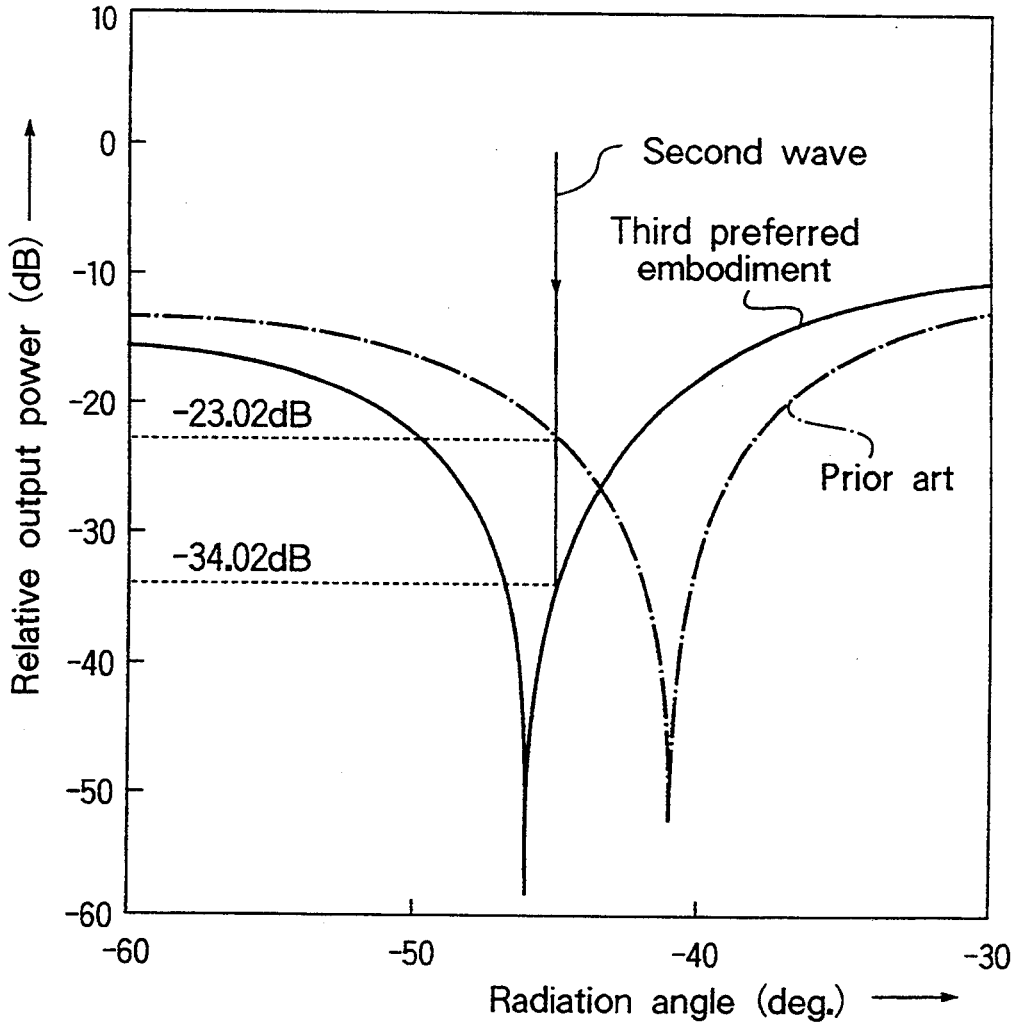
FIG. 11 is a graph of simulation results showing a transmitting radiation pattern in the control apparatus of the third preferred embodiment and a transmitting pattern of the prior art which is obtained when receiving weight coefficients are given as transmitting weight coefficients for the transmitting signals.

FIG. 11 is a graph of simulation results performed by the present inventors, showing a transmitting radiation pattern in the control apparatus for controlling the array antenna 1 of the third preferred embodiment and a transmitting radiation pattern of the prior art obtained when the receiving weight coefficients $w_n$ are given to the transmitting weight coefficients as they are. The transmission radiation pattern is a radiation pattern of the transmitting signals in the case where, under a radio wave environment similar to that of the first preferred embodiment, after the first radio wave is received from the radio station of the destination to communicate, the second radio wave that has come up as a result of the first radio wave's reflected by another object is received.

As is apparent from FIG. 11, in the transmission radiation pattern of the prior art when the receiving weight coefficients are given to the transmitting weight coefficients as they are without effecting any adaptive control to the transmitting signals, a relative output power at the radiation angle of the second radio wave is −23.02 dB, whereas the transmitting radiation pattern of the third preferred embodiment, which has been adaptive controlled, has a relative output power of −34.02 dB at the radiation angle of the second radio wave. In other words, it can be understood that the transmission power at the radiation angle of the second radio wave, which is the interference radio wave, can be remarkably attenuated, thereby remarkably reducing the effects of the second radio wave onto the transmitting signal radio wave.

As described above, in the third preferred embodiment, since both of the amplitudes and phases of the transmitting signals are controlled, the composition of the control apparatus of the third preferred embodiment becomes slightly more complicated than those of the first and second preferred embodiments, however, the control apparatus of the third preferred embodiment has the above-mentioned advantageous effects (1) and (2) as described in the first preferred embodiment, while the error combined electric-field strength Ee becomes completely zero as described above so that the effects of the interference radio wave can be fully eliminated.

<Comparison in Reception Level of Interference Radio Wave Between the Third Preferred Embodiment and the Prior Art>

Now a comparison is made for the reception level of the interference radio wave with a reference level of the main beam of transmitting radio signal (i.e. so-called zero depth), between the case of the third preferred embodiment where the complex weight coefficients $Z_m$ represented by the Equation 9 are given to the transmitting signals and another case of the prior art where the receiving weight coefficients $w_n$ are given to the transmitting signals as they are.

A reception level Ept of the interference radio wave in the case of the third preferred embodiment and a reception level Ect of the interference radio wave in the case of the prior art can be represented by the following Equations 20 and 21, respectively:

$$Ept=(\Delta f).(x_1-x_0).f'(x_1-x_0) \quad \text{Equation 20}$$

$$Ect=[1-f(\Delta f.x_1)].f(x_1-x_0)+(\Delta f).x_1.f'(x_1-x_0) \quad \text{Equation 21}$$

where $$\Delta f=|ft-fr| \quad \text{Equation 22}$$

$$f(x)=(1/N).\{sin(Nx)/\sin(x)\} \quad \text{Equation 23}$$

$$f'(x)=(1/N).\{N\cos(Nx)/\sin(Nx)-\sin(Nx).\cos(x)/\sin^2(x)\} \quad \text{Equation 24}$$

In this case, a radiation direction $\theta_0$ of the main beam of the transmitting radio signal and an incoming direction $\theta_1$ of the interference radio wave were normalized into $x_0$ and $x_1$, respectively, which are represented by the following Equations 25 and 26:

$$x_0=\pi/\lambda.d.\sin(\theta_0) \quad \text{Equation 25}$$

$$x_1=\pi/\lambda.d.\sin(\theta_1) \quad \text{Equation 26}$$

where λ is a wavelength of the receiving frequency fr, and d is a distance between respective adjacent antenna elements 100-m of the array antenna 1.

In a comparison between the above-mentioned Equation 20 and the Equation 21, the reception level Ept of the interference radio wave in the case of the third preferred embodiment can be represented by only the first-order term of (Δf), whereas the reception level Ec of the interference radio wave in the case of the prior art has the term of $[1-f(\Delta f.x_1)].f(x_1-x_0)$ in addition to the above-mentioned first-order term of (Δf). Accordingly, it can be understood that the reception level Ept of the interference radio wave in the case of the third preferred embodiment is smaller than the reception level Ect of the interference radio wave of the prior art. This allows the reception level of the interference radio wave to be reduced in the third preferred embodiment.

<Modifications>

In the preferred embodiments described hereinabove, the receiving frequency fr and the transmitting frequency ft have been set so as to be different from each other. However, the present invention is not limited to this. Even if the receiving frequency fr is set so as to be same as the transmitting frequency ft, the present invention can obtain the above-described functions and advantageous effects.

In the second and third preferred embodiments, the amplitude changeable or variable gain type high output power amplifier 6a is used. However, in the present invention, there may be provided only at least amplitude changing means for changing the amounts of amplitude of transmitting signals in correspondence to the antenna elements 100-m without being limited to the above arrangement. The amplitude changing means may be, for example, an attenuator, or a combination circuit of the attenuator and the amplifier circuit, or the like.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An apparatus for controlling an array antenna including a predetermined plurality of M antenna elements arranged closely to one another in a predetermined arrangement configuration, said apparatus comprising:

multi-beam forming means for calculating beam electric field strengths of a plurality of N beams of transmitting signals, based on a receiving frequency of receiving signals, a plurality of M receiving signals respectively received by said antenna elements of said array antenna, and directions of predetermined plurality of N beams of transmitting signals to be formed, said directions having been predetermined so that a desired radio wave can be received in a predetermined range of radiation angle;

beam selecting means for comparing said plurality of N beam electric field strengths calculated by the multi-beam forming means with a predetermined threshold value, and selectively outputting signals representing said beam electric field strengths equal to or larger than said threshold value;

adaptive controlling means, based on said signals representing said beam electric field strengths outputted from said beam selecting means, for calculating a plurality of N weight coefficients for the receiving signals respectively corresponding to the plurality of N beams of transmitting signals, said weight coefficients being calculated such that a main beam of the array antenna is directed toward an incoming direction of a desired radio wave and also a level of said receiving signal in an incoming direction of an unnecessary radio wave are made zero;

calculating means, based on said plurality of N weight coefficients calculated by said adaptive controlling means and a transmitting frequency of the transmitting signals, for calculating at least either one of a plurality of M amounts of phase shift and a plurality of M amounts of amplitude for the transmitting signals, respectively corresponding to said antenna elements, such that the main beam of the array antenna is directed toward the incoming direction of the desired radio wave and also the level of the transmitting signal in the incoming direction of the unnecessary radio wave are made zero; and antenna controlling means for controlling said antenna elements of said array antenna, respectively, in accordance with at least one of said plurality of M amounts of phase shift calculated by said calculating means and said plurality of M amounts of amplitude calculated by said calculating means, thereby radiating the controlled transmitting signals from said antenna elements of said array antenna.

2. The apparatus as claimed in claim 1, wherein said antenna controlling means comprises at least either one of:

phase shifting means for shifting phases of the transmitting signals in correspondence to said antenna elements, respectively, by said plurality of M amounts of phase shift calculated by said calculating means, and outputting the transmitting signals having the shifted phases to said antenna elements of said array antenna; and amplitude changing means for changing amplitudes of the transmitting signals in correspondence to said antenna elements, respectively, by said plurality of M amounts of amplitude calculated by said calculating means, respectively, and outputting the transmitting signals having the changed amplitudes to said antenna elements of said array antenna.

3. The apparatus as claimed in claim 1, further comprising:

amplifying means for amplifying said signals representing said beam electric field strengths outputted from said beam selecting means, respectively, with gains proportional to said plurality of N weight coefficients calculated by said adaptive controlling means; and combining means for combining in phase said receiving signals amplified by said amplifying means, thereby outputting said combined receiving signals as a receiving signal.

4. The apparatus as claimed in claim 2, further comprising:

amplifying means for amplifying said signals representing said beam electric field strengths outputted from said beam selecting means, respectively, with gains proportional to said plurality of N weight coefficients calculated by said adaptive controlling means; and combining means for combining in phase said receiving signals amplified by said amplifying means, thereby outputting said combined receiving signals as a receiving signal.

5. A method for controlling an array antenna including a predetermined plurality of M antenna elements arranged closely to one another in a predetermined arrangement configuration, said method including the following steps of:

calculating beam electric field strengths of a plurality of N beams of transmitting signals, based on a receiving frequency of receiving signals, a plurality of M receiving signals respectively received by said antenna elements of said array antenna, and directions of predetermined plurality of N beams of transmitting signals to be formed, said directions having been predetermined so that a desired radio wave can be received in a predetermined range of radiation angle;

comparing said calculated plurality of N beam electric field strengths with a predetermined threshold value, and selectively outputting signals representing said beam electric field strengths equal to or larger than said threshold value;

based on said outputted signals representing said beam electric field strengths, calculating a plurality of N weight coefficients for the receiving signals respectively corresponding to the plurality of N beams of transmitting signals, said weight coefficients being calculated such that a main beam of the array antenna is directed toward an incoming direction of a desired radio wave and also level of said receiving signal in an incoming direction of an unnecessary radio wave are made zero;

based on said calculated plurality of N weight coefficients and a transmitting frequency of the transmitting signals, calculating at least either one of a plurality of M amounts of phase shift and a plurality of M amounts of amplitudes for the transmitting signals, respectively corresponding to said antenna elements, such that the main beam of the array antenna is directed toward the incoming direction of the desired radio wave and also the level of the transmitting signal in the incoming direction of the unnecessary radio wave are made zero; and controlling said antenna elements of said array antenna, respectively, in accordance with at least one of said calculated plurality of M amounts of phase shift and said calculated plurality of M amounts of amplitude, thereby radiating the controlled transmitting signals from said antenna elements of said array antenna.

6. The method as claimed in claim 5, wherein said controlling step includes at least either one step of the following steps:

shifting phases of the transmitting signals in correspondence to said antenna elements, respectively, by said calculated plurality of M amounts of phase shift, and outputting the transmitting signals having the shifted phases to said antenna elements of said array antenna; and changing amplitudes of the transmitting signals in correspondence to said antenna elements, respectively, by said calculated plurality of M amounts of amplitude, respectively, and outputting the transmitting signals having the changed amplitudes to said antenna elements of said array antenna.

* * * * *